US009825369B2

(12) United States Patent
Takasaki et al.

(10) Patent No.: US 9,825,369 B2
(45) Date of Patent: Nov. 21, 2017

(54) ANTENNA DEVICE

(71) Applicant: CANON KABUSHIKI KAISHA, Tokyo (JP)

(72) Inventors: Atsushi Takasaki, Tokyo (JP); Koji Yukimasa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 131 days.

(21) Appl. No.: 14/644,459

(22) Filed: Mar. 11, 2015

(65) Prior Publication Data

US 2015/0270622 A1 Sep. 24, 2015

(30) Foreign Application Priority Data

Mar. 20, 2014 (JP) ..... 2014-059076

(51) Int. Cl.

| | |
|---|---|
| ***H01Q 15/00*** | (2006.01) |
| ***H01Q 21/24*** | (2006.01) |
| ***H01Q 21/30*** | (2006.01) |
| ***H01Q 5/385*** | (2015.01) |
| ***H01Q 1/36*** | (2006.01) |
| ***H01Q 9/16*** | (2006.01) |

(52) U.S. Cl.

CPC ..... *H01Q 15/0013* (2013.01); *H01Q 1/36* (2013.01); *H01Q 5/385* (2015.01); *H01Q 9/16* (2013.01); *H01Q 15/008* (2013.01); *H01Q 21/24* (2013.01); *H01Q 21/30* (2013.01)

(58) Field of Classification Search

CPC ..... H01Q 15/0013; H01Q 5/385; H01Q 9/16
USPC ..... 343/909, 797, 700 MS
See application file for complete search history.

(56) References Cited

U.S. PATENT DOCUMENTS 6,289,036 B1 9/2001 Saito et al.
6,545,647 B1 * 4/2003 Sievenpiper ..... H01Q 21/245 343/795
6,657,592 B2 * 12/2003 Dening ..... H01Q 1/243 343/700 MS
6,707,841 B1 3/2004 Takasaki
(Continued)

FOREIGN PATENT DOCUMENTS

JP 2005-094360 A 4/2005
JP 2009-21897 A 1/2009
(Continued)

OTHER PUBLICATIONS

European Search Report dated Jul. 30, 2015 issued in corresponding European Patent Application No. 151599322.1.

*Primary Examiner* — Dameon E Levi
*Assistant Examiner* — Hasan Islam
(74) *Attorney, Agent, or Firm* — Fitzpatrick, Cella, Harper & Scinto

(57) ABSTRACT

An antenna device comprises a cell structure including a plurality of cells made up of a multi-layer structure including a conductor layer and a dielectric layer, arranged in a matrix, and further comprises a first antenna element and a second antenna element arranged over the cell structure. The cells are configured to have artificial magnetic conductor effects corresponding to different frequency bands in a first direction and a second direction, and the first antenna element and the second antenna element are arranged parallel to the surface of the cell structure, respectively along the first direction and the second direction.

7 Claims, 7 Drawing Sheets

(56) References Cited

U.S. PATENT DOCUMENTS

| | | | | |
|---|---|---|---|---|
| 7,079,079 | B2 * | 7/2006 | Jo | H01Q 1/243 343/700 MS |
| 8,325,104 | B2 * | 12/2012 | Sim | H01Q 1/2225 343/795 |
| 8,406,452 | B2 | 3/2013 | Kajihara et al. | |
| 8,686,916 | B2 | 4/2014 | Yukimasa et al. | |
| 2003/0201938 | A1 | 10/2003 | Dening et al. | |
| 2005/0068233 | A1 | 3/2005 | Tanaka et al. | |
| 2010/0039343 | A1 | 2/2010 | Uno et al. | |
| 2010/0268801 | A1 | 10/2010 | Yukimasa | |
| 2013/0306363 | A1 | 11/2013 | Yukimasa | |
| 2013/0314285 | A1 | 11/2013 | Takasaki | |
| 2014/0097995 | A1 * | 4/2014 | McKinzie, III | H01Q 9/0407 343/793 |
| 2015/0054713 | A1 | 2/2015 | Takasaki | |

FOREIGN PATENT DOCUMENTS

| | | | |
|---|---|---|---|
| JP | 2011-55036 | A | 3/2011 |
| KR | 10-2008-0050928 | A | 6/2008 |
| WO | 02/41447 | A1 | 5/2002 |
| WO | 2008/050441 | A1 | 5/2008 |

* cited by examiner

ANTENNA DEVICE

BACKGROUND OF THE INVENTION

Field of the Invention

The present invention relates to an antenna device. In particular, the present invention relates to a planar structure having a high surface impedance, and an antenna device employing this planar structure.

Description of the Related Art

In recent years, research has been conducted on technology related to an electromagnetic band gap structure (hereinafter "EBG structure") that blocks the propagation of electromagnetic waves in a specific frequency bandwidth. One conceivable EBG structure has a structure in which rectangular patch conductors are arranged in a matrix in the same plane with a constant gap interval, and conductive vias from the patch conductors are connected to ground conductors arranged parallel to the patch conductors. In this structure, the set of one patch conductor, one ground conductor, and one conductive via is called a mushroom structure due to its shape. Besides blocking electromagnetic waves, this EBG structure also exhibits an effect of a artificial magnetic conductor that has a high surface impedance in a specific frequency bandwidth. By focusing on this artificial magnetic conductor characteristic and using the EBG structure for antenna dimension lowering, there is expectation for realizing an effective artificial magnetic conductor type low-dimensioned antenna.

With conventional artificial magnetic conductor type low-dimensioned antennas that employ an EBG structure, it has only been possible to realize a structure in which one EBG structure is provided for one antenna element, and therefore it has been difficult to achieve dimension lowering in a multiband antenna.

SUMMARY OF THE INVENTION

The present invention has been achieved in light of the above-described circumstances, and provides a low-dimensioned antenna that can operate at multiple resonance frequencies.

According to one aspect of the present invention, there is provided an antenna device which comprises a cell structure including a plurality of cells made up of a multi-layer structure including a conductor layer and a dielectric layer, arranged in a matrix, and further comprising a first antenna element and a second antenna element arranged over the cell structure, wherein the cells are configured to have artificial magnetic conductor effects corresponding to different frequency bands in a first direction and a second direction, and the first antenna element and the second antenna element are arranged parallel to the surface of the cell structure, respectively along the first direction and the second direction.

Further features of the present invention will become apparent from the following description of exemplary embodiments with reference to the attached drawings.

DESCRIPTION OF THE EMBODIMENTS

Hereinafter, some embodiments of the present invention will be described in detail with reference to the accompanying drawings. Note that the configurations described in the following embodiments are merely examples, and the present invention is not intended to be limited to the illustrated configurations.

One feature of a metamaterial structure is the artificial magnetic conductor effect. The surface provided with the periodic structure is a structure having a high surface impedance and realizes in-phase reflection in a specific frequency bandwidth. With a metamaterial artificial magnetic conductor that has a periodic structure made up of repeating unit cell structures, a structure having different artificial magnetic conductor characteristics in two directions can be realized by setting asymmetric conditions for the unit cell structure and periodic structure. For example, in a artificial magnetic conductor having a mushroom structure made up of a patch conductor having different dimensions in the vertical and horizontal directions, artificial magnetic conductor effects corresponding to two different frequency bandwidths are obtained. If antenna elements that operate in two frequency bands are arranged such that their structures have different resonance directions, and a periodic structure having artificial magnetic conductor structures exhibiting effects in the two operating bands of the antennas is arranged below the antenna elements, it is possible to realize a low-dimensioned dual band antenna in which influence from the GND conductor on the underside has been mitigated. Two embodiments will be described below.

First Embodiment

Figure 1:
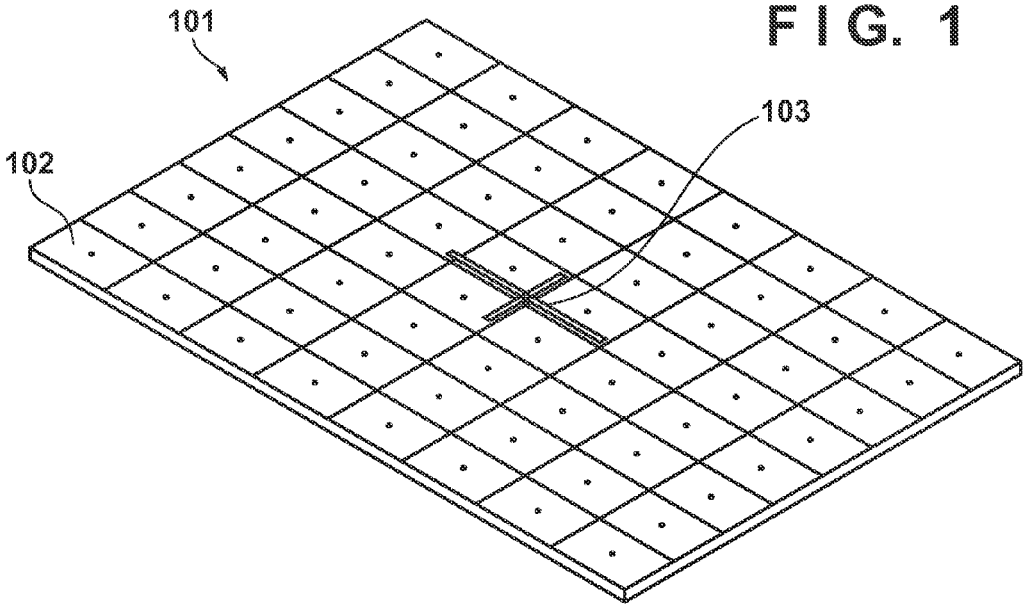
FIG. 1 is a diagram showing a configuration of a dual band low-dimensioned antenna according to a first embodiment.

FIG. 1 is an overall schematic diagram showing a dual band low-dimensioned antenna 101 according to the present embodiment. The dual band low-dimensioned antenna 101 according to the present embodiment includes a substrate on which EBG structure unit cells 102 are arranged in an 8×8 matrix, and a dual frequency orthogonal dipole antenna 103 is arranged parallel to the substrate in the central region thereof. The unit cells 102 each have a mushroom structure with a rectangular shape of approximately 10×15 mm, and are arranged periodically in a matrix such that the effect of a artificial magnetic conductor is exhibited.

Figure 2:
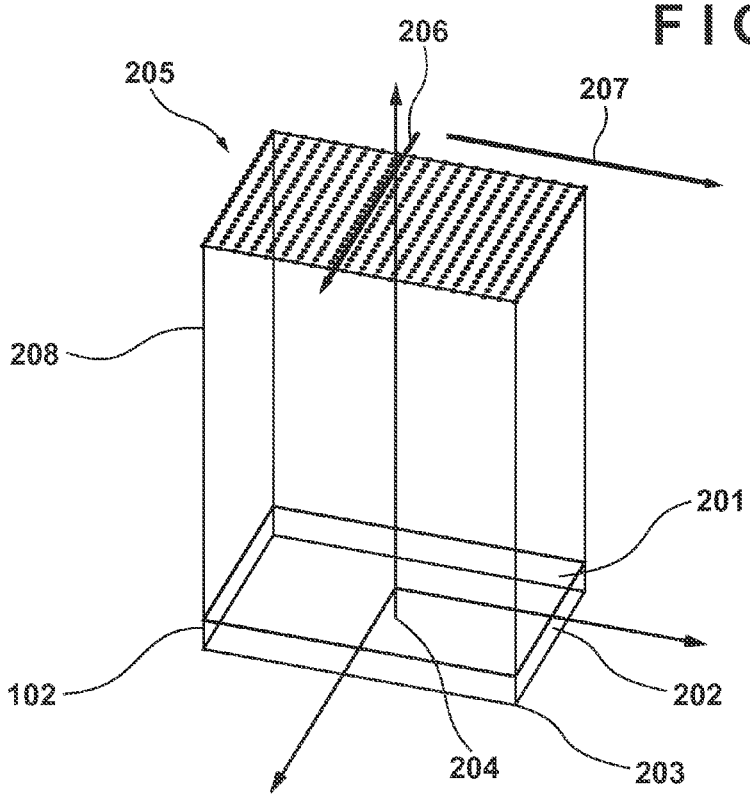
FIG. 2 is a model diagram in the case of performing simulation analysis on unit cells of an EBG structure.

FIG. 2 is a model diagram in the case of performing simulation analysis on the EBG structure unit cells 102. Each unit cell 102 is constituted by an upper rectangular patch conductor 201, a dielectric layer 202, a lower GND conductor 203, and a connection via 204 that connects these conductors of the multi-layer structure. An electromagnetic wave incidence surface 205 is set for analysis in order to observe the artificial magnetic conductor characteristics of the unit cell 102. The phase of reflected waves in the EBG structure is analyzed at the electromagnetic wave incidence surface 205 with respect to electromagnetic waves in the direction of an arrow 206 and electromagnetic waves in the direction of an arrow 207. A surface 208 is a surface forming a boundary of the periodic structure, and the analysis space is set as the period structure including repeating unit cell structures at four surfaces in the horizontal direction.

Figure 3:
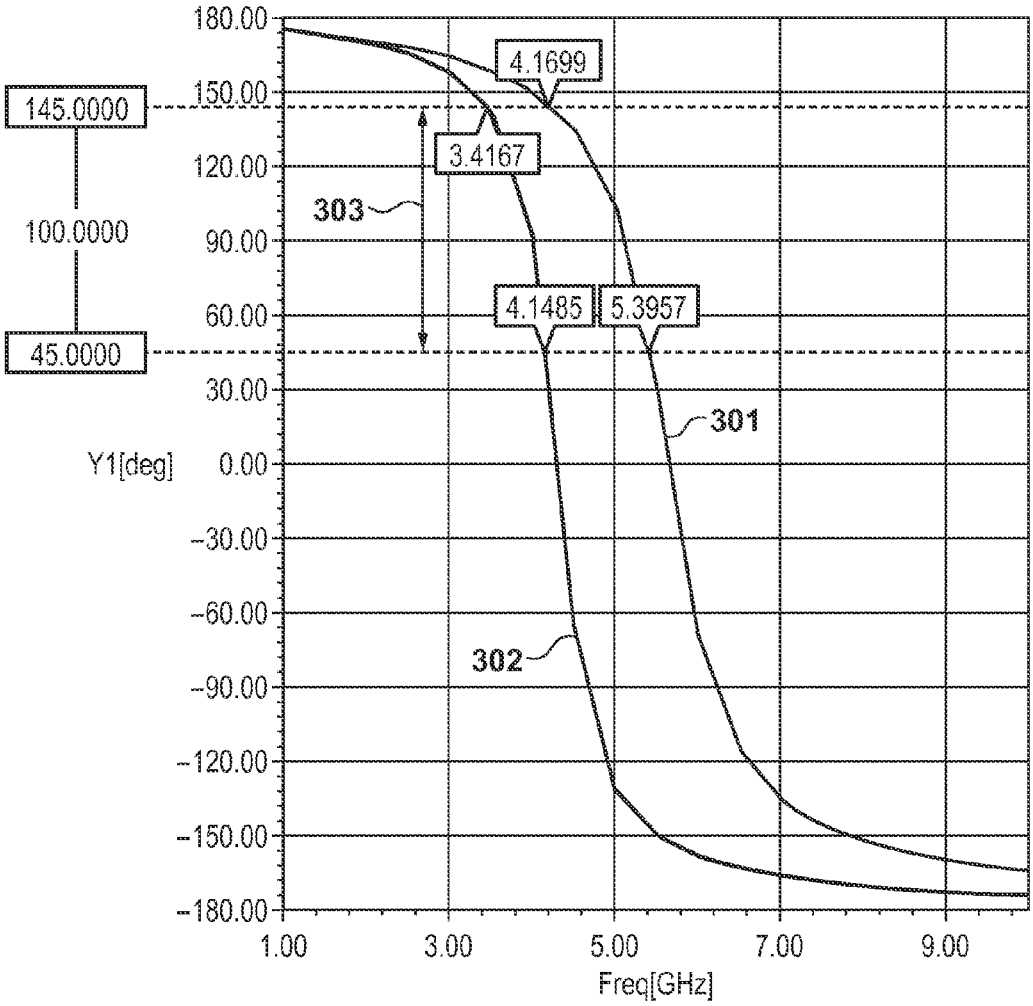
FIG. 3 is a diagram showing results of analysis on the dual band low-dimensioned antenna according to the first embodiment.

FIG. 3 is a graph showing the results of analyzing the model shown in FIG. 2. In FIG. 3, the horizontal axis indicates the frequency, and the vertical axis indicates the reflected wave phase. A curve 301 indicates change in the reflected wave phase relative to electromagnetic waves in the direction of the arrow 206 in FIG. 2, and a curve 302 indicates change in the reflected wave phase relative to electromagnetic waves in the direction of the arrow 207 in FIG. 2. Within the range in which the reflected wave phase is not ±180°, a range 303 of approximately 45° to 135° is assumed to be the section corresponding to effective operation as a artificial magnetic conductor. In this case, it can be said that the curve 301 and the curve 302 indicate effective operation as a artificial magnetic conductor from 4.1 GHz to 5.7 GHz and from 3.4 GHz to 4.1 GHz respectively. Note that although a similar artificial magnetic conductor effect can be expected in the section in which the reflected wave phase is approximately −45° to −135° as well, this region is higher than the frequency range, and therefore the frequency range in the reflection coefficient range 303 from 45° to 135° is used.

Figure 4:
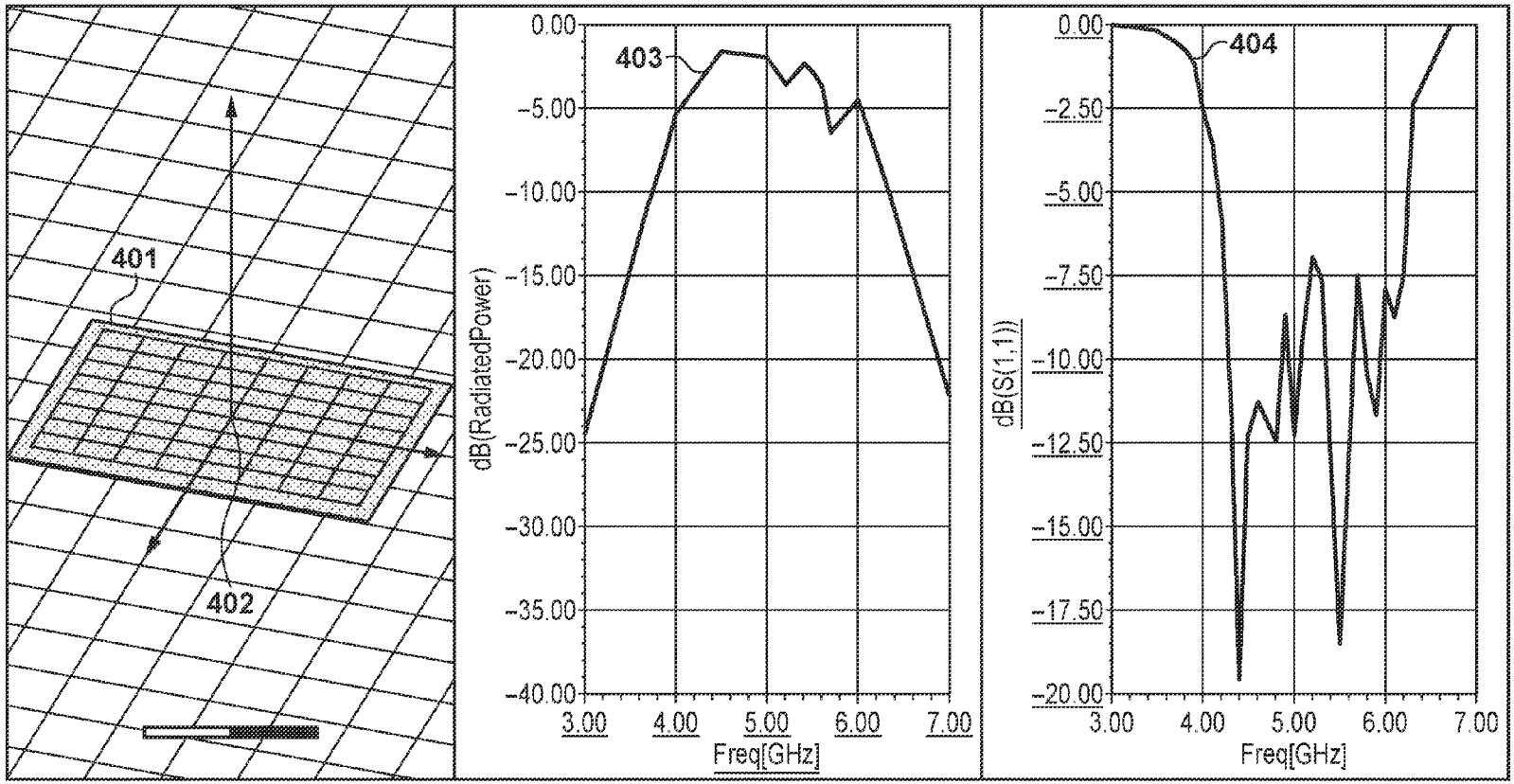
FIG. 4 is a diagram showing antenna radiation characteristics according to the first embodiment.

FIG. 4 shows results confirmed in a simulation of the case where antenna radiation characteristics were ensured by the artificial magnetic conductor effect. A substrate 401 is an FR4 substrate in which EBG structure unit cells 102 are arranged in an 8×8 matrix, and a dipole antenna 402 is arranged in the central region thereof. The dipole antenna 402 resonates at approximately 5 GHz and is fixed at a height of 1.2 mm from the substrate 401. A curve 403 indicates the antenna radiation efficiency, and a curve 404 indicates the antenna S11 reflection characteristic (antenna reflection loss). It can be understood from the features of the curve 403 that the radiation efficiency is high in the vicinity of 5 GHz, and it can be understood from the features of the curve 404 that the S11 reflection characteristic is suppressed to a low level in the vicinity of 5 GHz. In other words, it can be understood from these curves that electromagnetic wave radiation is not inhibited by the artificial magnetic conductor effect at the resonance frequency of the dipole antenna.

Figure 5:
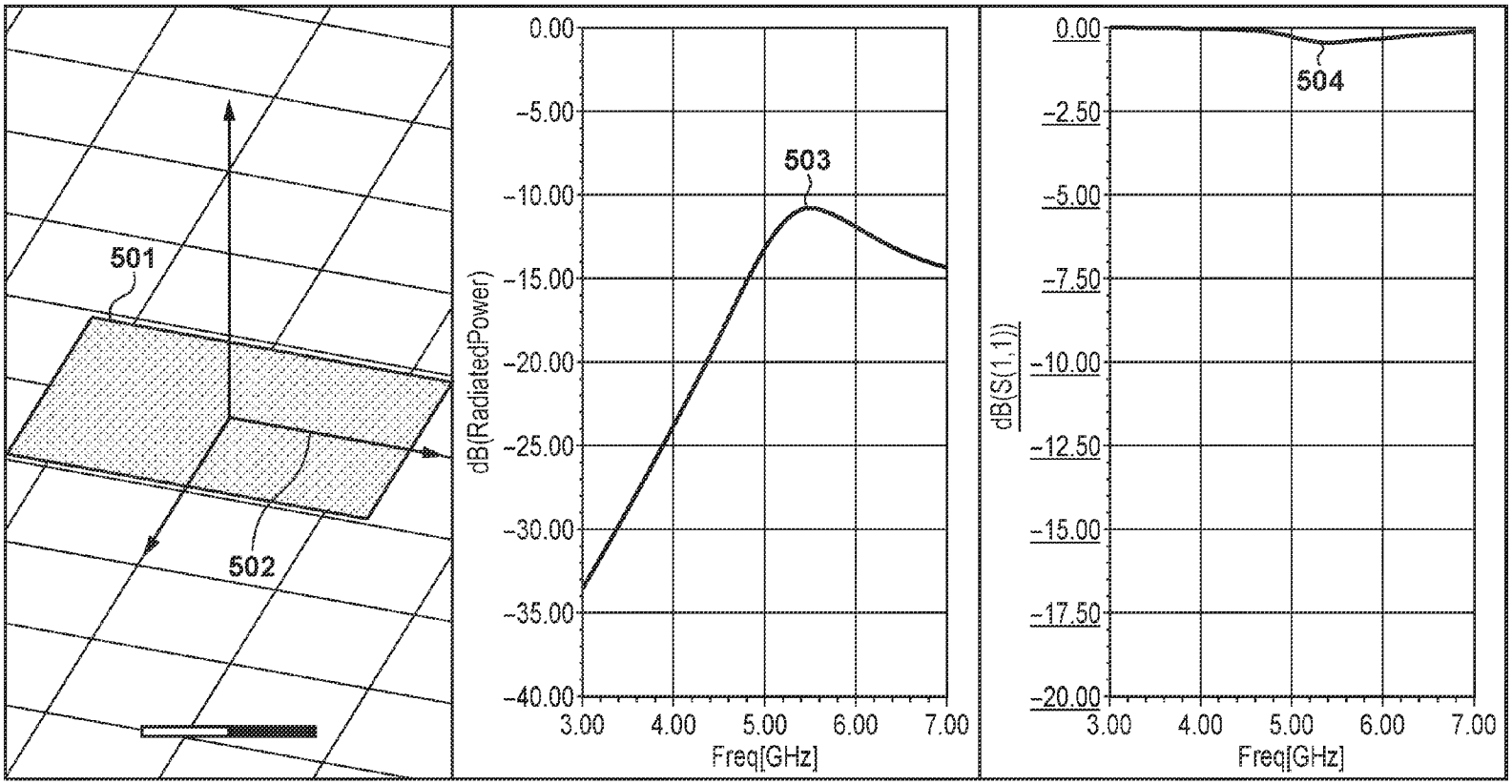
FIG. 5 is a diagram showing antenna radiation characteristics according to a conventional example.

For comparison, FIG. 5 shows the characteristics of an antenna 502 in the case where conductors not exhibiting the artificial magnetic conductor effect are arranged uniformly. The conductors are arranged uniformly on the surface of a substrate 501, and the antenna reflection characteristic is in an approximately total reflection state. A curve 503 indicates the antenna radiation efficiency, and a curve 504 indicates the antenna S11 reflection characteristic (antenna reflection loss). In comparison with the curve 403 in FIG. 4, it can be confirmed that the curve 503 indicates a 10 dB to 20 dB reduction in radiation efficiency in the vicinity of 5 GHz. Also, in comparison with the curve 404 in FIG. 4, it can be confirmed that the curve 504 indicates a 10 dB to 20 dB reduction in the S11 reflection characteristic in the vicinity of 5 GHz.

Figure 6:
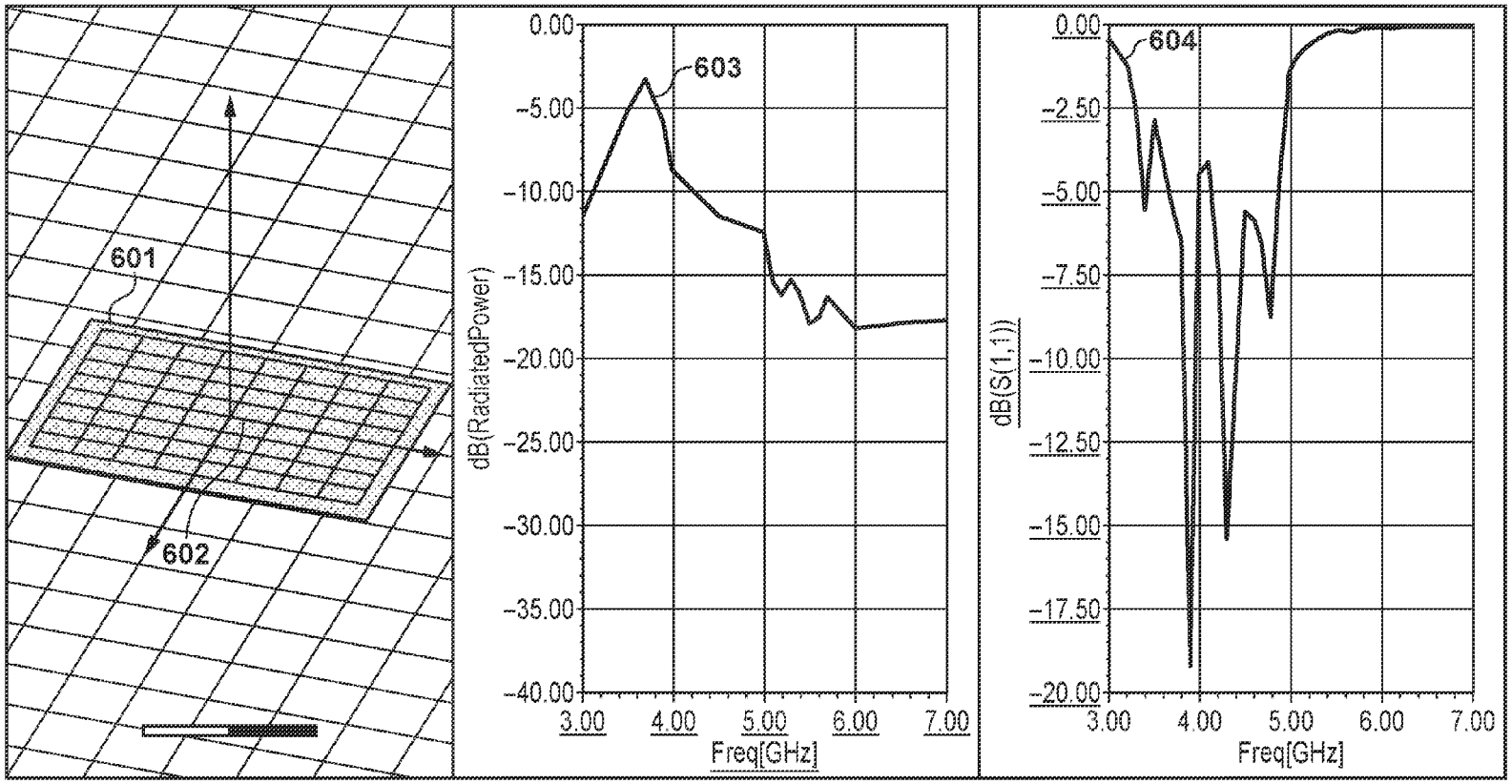
FIG. 6 is another diagram showing antenna radiation characteristics according to the first embodiment.

FIG. 6 shows results confirmed in a simulation of the case where antenna radiation characteristics at a different frequency from FIG. 4 were ensured by the artificial magnetic conductor effect in a different direction. Similarly to FIG. 4, a substrate 601 is an FR4 substrate in which EBG structure unit cells 102 are arranged in an 8×8 matrix, and a dipole antenna 602 is arranged in the central region thereof. The dipole antenna 602 resonates at approximately 3.7 GHz and is fixed at a height of 1.5 mm from the substrate 601, in a direction orthogonal to the direction of the dipole antenna 402 in FIG. 4. A curve 603 indicates the antenna radiation efficiency, and a curve 604 indicates the antenna S11 reflection characteristic. It can be understood from the features of the curve 603 that the radiation efficiency is high in the vicinity of 3.7 GHz, and it can be understood from the features of the curve 604 that the S11 reflection characteristic is suppressed to a low level in the vicinity of 3.7 GHz. In other words, it can be understood from these curves that electromagnetic wave radiation is not inhibited by the artificial magnetic conductor effect at the resonance frequency of the dipole antenna 602.

Figure 7:
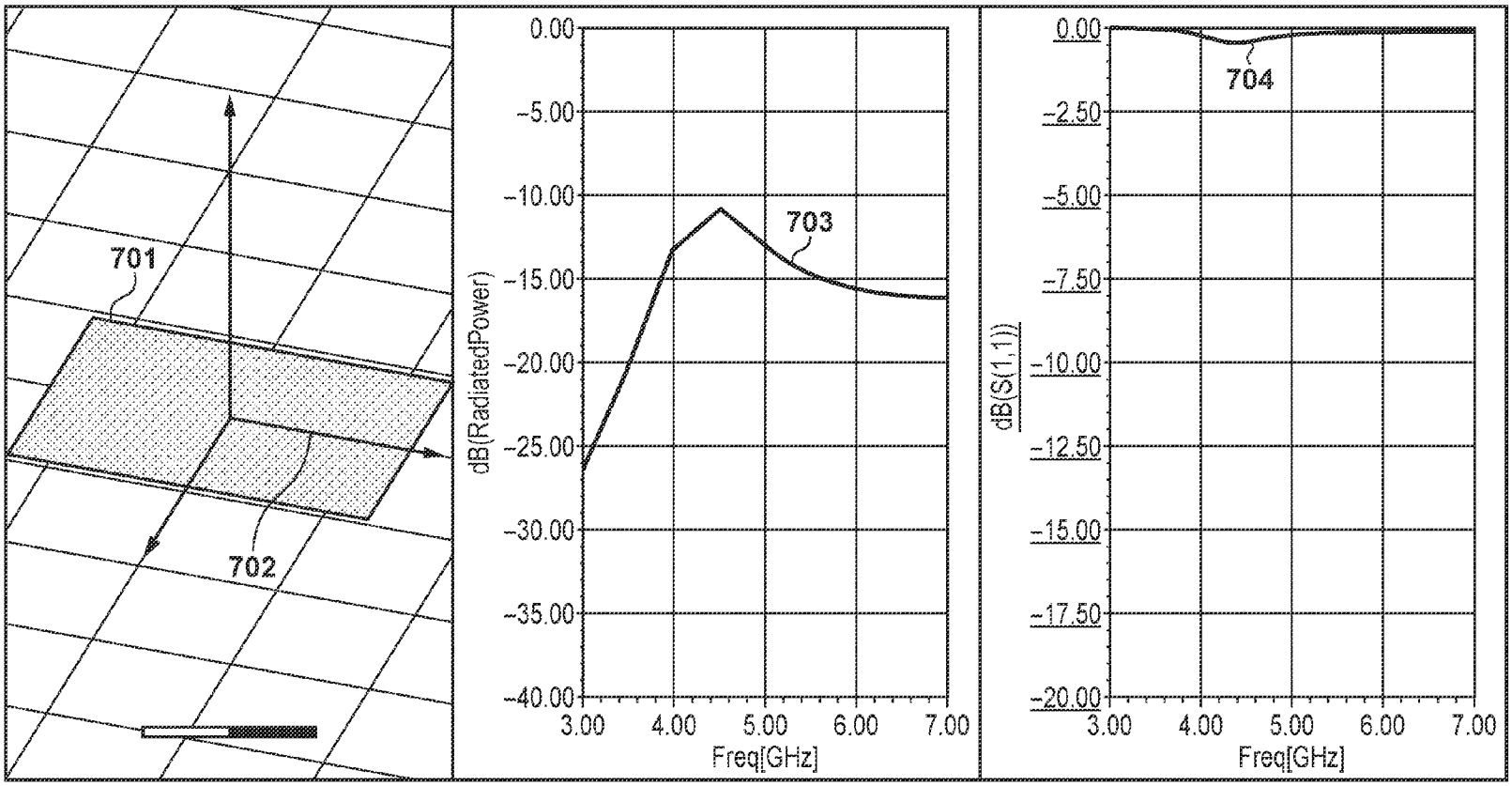
FIG. 7 is another diagram showing antenna radiation characteristics according to the conventional example.

For comparison, FIG. 7 shows the characteristics of an antenna 702 in the case where conductors not exhibiting the artificial magnetic conductor effect are arranged uniformly instead of a artificial magnetic conductor. The conductors are arranged uniformly on the surface of a substrate 701, and the antenna reflection characteristic is in an approximately total reflection state. A curve 703 indicates the antenna radiation efficiency, and a curve 704 indicates the antenna S11 reflection characteristic (antenna reflection loss). In comparison with the curve 603 in FIG. 6, it can be confirmed that the curve 703 indicates a 10 dB to 20 dB reduction in radiation efficiency in the vicinity of 3.7 GHz. Also, in comparison with the curve 604 in FIG. 6, it can be confirmed that the curve 704 indicates a 10 dB to 20 dB reduction in the S11 reflection characteristic in the vicinity of 3.7 GHz.

As described above, according to the present embodiment, by arranging multiple antenna elements in multiple directions for exhibiting desired artificial magnetic conductor effects on the surface of an EBG structure, it is possible to realize dimension lowering in a multiband antenna. Specifically, in the present embodiment, it is possible to configure a dual band low-dimensioned antenna by arranging a dipole antenna at the short distance of 1.2 to 1.5 mm from an EBG substrate having a GND layer on the underside as shown in FIG. 1. This distance of 1.2 to 1.5 mm is shorter than ¼ the wavelength of the resonance frequency band. Also, when designing the arrangement of a built-in antenna in a product, it is possible to realize an antenna arrangement that does not allow radiation characteristic degradation even in the vicinity of a member that causes antenna operation degradation such as a circuit substrate or a metal frame.

Second Embodiment

Figure 8:
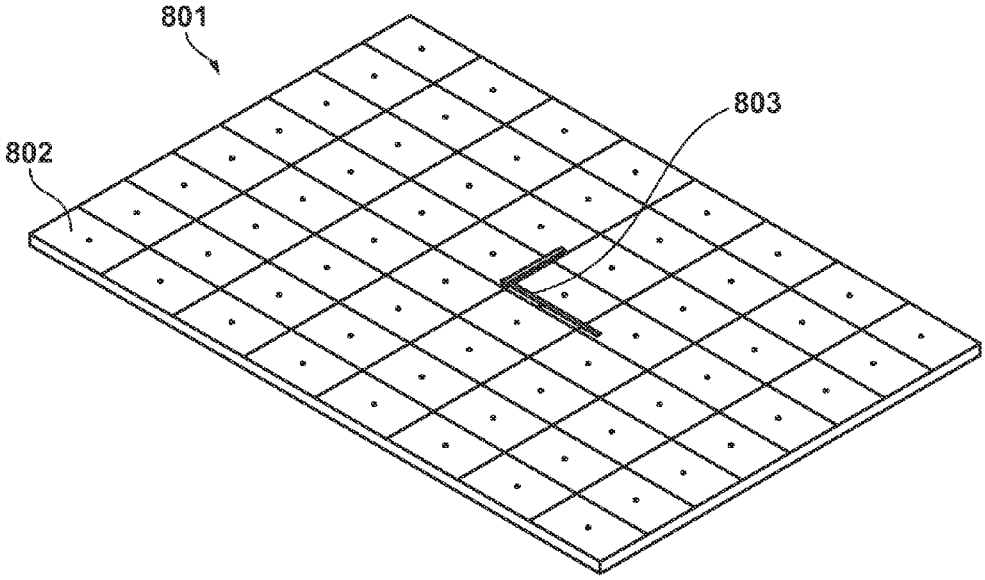
FIG. 8 is a schematic diagram of a dual band low-dimensioned antenna according to a second embodiment.

FIG. 8 is an overall schematic diagram showing a dual band low-dimensioned antenna 801 according to the present embodiment. The dual band low-dimensioned antenna 801 according to the present embodiment includes a substrate on which EBG structure unit cells 802 are arranged in an 8×8 matrix, and a dual frequency orthogonal inverted F antenna 803 is arranged parallel to the substrate in the central region thereof. The EBG structure made up of the unit cells 802 has a configuration similar to the configuration described in the first embodiment, and exhibits a artificial magnetic conductor effect.

Figure 9:
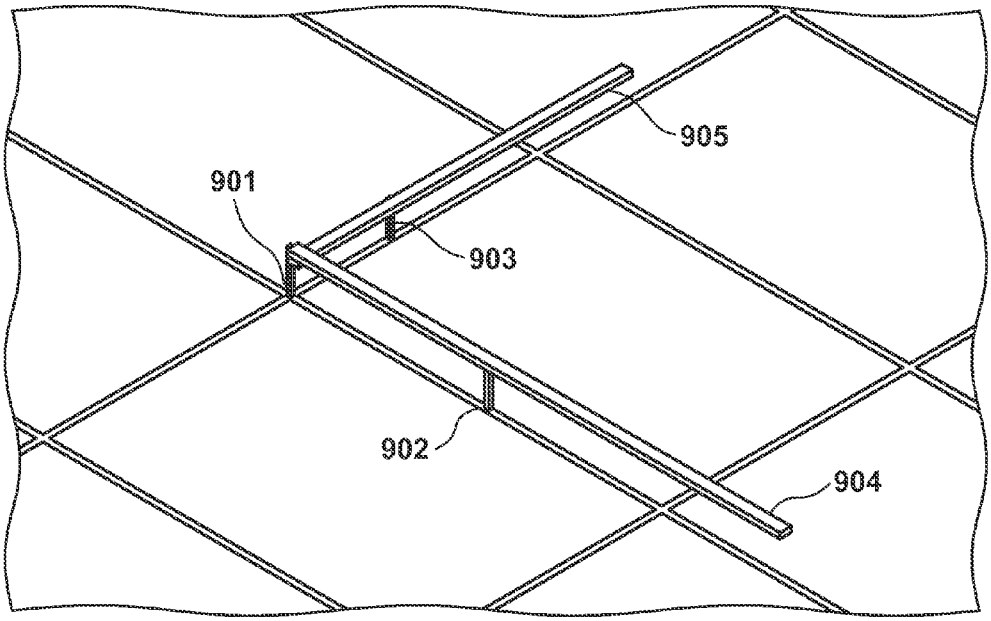
FIG. 9 is a diagram showing a configuration of a dual frequency orthogonal inverted F antenna.

FIG. 9 shows the configuration of the dual frequency orthogonal inverted F antenna. A supply line 901 is a signal line that transmits wireless signals from a circuit portion arranged on the underside of the substrate constituting the EBG structure, for example. Elements 902 and 903 are GND elements of two inverted F antenna element conductors 904 and 905, are connected to a GND conductor on the underside of the substrate constituting the EBG structure, and perform impedance matching for the inverted F antennas. The antenna element conductor 904 and the antenna element conductor 905 can be arranged at mutually different distances from the substrate.

In the present embodiment, the inverted F antenna element conductors 904 and 905 are arranged in the top layer, the patch conductor layer of the EBG structure made up of unit cells 802 is arranged in the second layer, and the GND layer is arranged in the bottom layer. Using vias connecting the layers, it is possible to configure a multilayer substrate in which the vias constituting the EBG structure, the supply line 901, and the GND elements 902 and 903 of the two inverted F antennas are integrated. In other words, with the above-described configuration, it is possible to realize the low-dimensioned antenna 801 of the present embodiment on one FR4 substrate. Furthermore, by arranging the circuit substrate layer below the GND layer, it is possible to also configure a substrate integrated with a wireless circuit.

As described above, according to the present embodiment, it is possible to realize dimension lowering in a multiband antenna similarly to the first embodiment. Also, when designing the arrangement of a built-in antenna in a product, it is possible to realize an antenna arrangement that does not allow radiation characteristic degradation even in the case of mounting in the vicinity of a member that causes antenna operation degradation such as a metal frame or the substrate for circuitry other than the wireless portion.

Note that although a dipole antenna and inverted F antennas are used as the low-dimensioned antenna elements in the above-described embodiments, there is no limitation to this. With any antenna element that has a resonance direction as a conductor in a specific direction, by matching the resonance direction with the artificial magnetic conductor direction, similar effects can be exhibited. Also, although an EBG structure having a mushroom structure with rectangular patches is used in the above-described embodiments, there is no limitation to this. There are other techniques for realizing a structure that exhibits artificial magnetic conductor characteristics in multiple directions, and effects similar to the above embodiments can be exhibited with these other techniques as well. Also, although the directions of the artificial magnetic conductors are set to orthogonal directions in the above-described embodiments, there is no limitation to this. For example, even with directions set to 45° angles or other angles, with any structure in which artificial magnetic conductor effects as components are observed, by aligning the resonance directions of the antenna elements with the directions of the artificial magnetic conductor components, similar effects can be exhibited.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-059076, filed Mar. 20, 2014, which is hereby incorporated by reference herein in its entirety.

What is claimed is:

1. An antenna device, comprising:

a cell structure that includes a plurality of cells made up of a multi-layer structure including a conductor layer and a dielectric layer, wherein the plurality of cells are arranged in a matrix;

a first antenna element; and a second antenna element, wherein the first antenna element and the second antenna element are arranged over the cell structure, wherein the plurality of cells are configured to have artificial magnetic conductor effects corresponding to different frequency bands in a first direction and a second direction, wherein the first direction is not parallel with the second direction, wherein the first antenna element and the second antenna element are arranged parallel to a surface of the cell structure, respectively along the first direction and the second direction, wherein the first antenna element exhibits resonance in the first direction, and the second antenna element exhibits resonance in the second direction, and wherein the first antenna element and the second antenna element form an inverted F antenna.

2. The antenna device according to claim 1, wherein the first antenna element exhibits resonance in a frequency bandwidth in which a reflected wave phase is not 180° relative to electromagnetic waves in the first direction, and the second antenna element exhibits resonance in a frequency bandwidth in which a reflected wave phase is not 180° relative to electromagnetic waves in the second direction.

3. The antenna device according to claim 1, wherein the first antenna element exhibits resonance in a frequency bandwidth in which a reflected wave phase is 45° to 135° relative to electromagnetic waves in the first direction, and the second antenna element exhibits resonance in a frequency bandwidth in which a reflected wave phase is 45° to 135° relative to electromagnetic waves in the second direction.

4. The antenna device according to claim 1, wherein the first antenna element is arranged such that a distance from the cell structure is shorter than ¼ a wavelength of a frequency at which the first antenna element exhibits resonance, and the second antenna element is arranged such that a distance from the cell structure is shorter than ¼ a wavelength of a frequency at which the second antenna element exhibits resonance.

5. The antenna device according to claim 1, wherein the first antenna element and the second antenna element are arranged at mutually different distances from the cell structure.

6. The antenna device according to claim 1, wherein the first antenna element and the second antenna element are arranged so as to exhibit resonance in orthogonal directions.

7. The antenna device according to claim 1, wherein a conductor in the conductor layer is rectangular.

* * * * *